US010443788B2

(12) United States Patent
Dong et al.

(10) Patent No.: US 10,443,788 B2
(45) **Date of Patent: *Oct. 15, 2019**

(54) DUAL-MODULAR DOWNLIGHT

(71) Applicant: XIAMEN ECO LIGHTING CO. LTD., Xiamen (CN)

(72) Inventors: Yongzhe Dong, Xiamen (CN); Shouqiang Hou, Xiamen (CN); Xiaoliang Wen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/608,741

(22) Filed: May 30, 2017

(65) Prior Publication Data

US 2018/0266634 A1 Sep. 20, 2018

(30) Foreign Application Priority Data

Mar. 15, 2017 (CN) ..... 2017 1 0152124

(51) Int. Cl.

| | |
|---|---|
| ***F21K 9/237*** | (2016.01) |
| ***F21S 8/02*** | (2006.01) |
| ***F21V 29/76*** | (2015.01) |
| ***F21V 29/75*** | (2015.01) |
| ***F21V 21/04*** | (2006.01) |
| *F21Y 115/10* | (2016.01) |

(52) U.S. Cl.

CPC ..... *F21K 9/237* (2016.08); *F21S 8/02* (2013.01); *F21V 21/041* (2013.01); *F21V 21/047* (2013.01); *F21V 29/75* (2015.01); *F21V 29/763* (2015.01); *F21Y 2115/10* (2016.08)

(58) Field of Classification Search

CPC ..... F21K 9/237; F21V 21/047; F21V 21/041; F21V 29/763; F21V 29/75; F21S 8/02; F21Y 2115/10

See application file for complete search history.

(56) References Cited

U.S. PATENT DOCUMENTS

| | | | | |
|---|---|---|---|---|
| 9,702,516 | B1 * | 7/2017 | Vasquez | F21V 21/04 |
| 2011/0075411 | A1 * | 3/2011 | Van De Ven | F21V 15/01 362/235 |
| 2013/0083531 | A1 * | 4/2013 | Lui | F21V 17/14 362/249.02 |
| 2013/0170190 | A1 * | 7/2013 | Song | F21V 21/044 362/147 |
| 2014/0160772 | A1 * | 6/2014 | Wu | F21S 8/026 362/373 |
| 2017/0248290 | A1 * | 8/2017 | Uhler | F21V 13/04 |
| 2017/0351019 | A1 * | 12/2017 | Kadowaki | G09F 9/00 |
| 2018/0266635 | A1 * | 9/2018 | Dong | F21K 9/237 |

* cited by examiner

*Primary Examiner* — Tracie Y Green

(74) *Attorney, Agent, or Firm* — Chun-Ming Shih; LanWay IPR Services

(57) ABSTRACT

Disclosed herein is a downlight, which includes an optoelectronic module and a rim module. The optoelectronic module includes a light source driving board, a back housing, and a front housing. The light source driving board is disposed between the back housing and the front housing. The light source driving board includes a light-emitting diode unit and a driving circuit. The rim module has a central opening for accommodating the optoelectronic module. The rim module is not integrally formed with the optoelectronic module.

7 Claims, 4 Drawing Sheets

DUAL-MODULAR DOWNLIGHT

CROSS-REFERENCE TO RELATED APPLICATION

This application relates to and claims the benefit of Chinese Patent Application No. CN201710152124.5, filed Mar. 15, 2017, the content of which is incorporated herein by reference in its entirety.

BACKGROUND OF THE INVENTION

1. Field of the Invention

The present disclosure relates to a downlight; more particularly, to a downlight having a light-emitting diode.

2. Description of Related Art

With the advancement of the technology, many modern lighting apparatuses now use light-emitting diodes (LEDs) as the light source. The downlight is a lighting device that is installed in the ceiling of the building. The downlight has a tubular appearance and can be embedded within the ceiling so that the front surface of the light is level with the ceiling, thereby giving a flat and even look. By placing the LED unit within the downlight, it is feasible to enhance the light efficiency and the aesthetics. However, in the conventional downlight, the light source module and the driver are separately designed, and the two has to be assembled individually following specific steps and fixed with screws separately; the structure of such downlight is very complicated, and the terminals for making electric conduction between the driver and the light source module should be taken into account, too. Accordingly, for the conventional downlight, the manufacturing process is complicated, the production efficiency is low, the cost is high, and the driver is an inserting piece with higher manufacturing and material cost and inferior efficiency. For the conventional product, a complete light is obtained only after all the components are assembled together, while a single component cannot exhibit its function, thereby limiting the application of the product. In view of the foregoing, there is an urgent need in the industrial field of the LED lighting to provide a novel product design that simplifies the assembly process, improves the test efficiency, enhance the manufacturing efficiency and increases the adaptability of the product.

SUMMARY

In light of the foregoing technical problems, the present inventor proposes the following embodiments to respectively address some or all of the technical problems.

One purpose of the present invention is to provide a dual-modular downlight, in which each module may be manufactured and tested separately, thereby increasing the production efficiency. Another purpose of the present invention is to provide a dual-modular downlight, in which the optoelectronic module and the rim module may be combined with each other, thereby increasing the adaptability of the product and improving the competitiveness. Still another purpose of the present invention is to provide a dual-modular downlight, which is easy-to-assemble and requires only a minimal amount of screws.

According to one embodiment of the present invention, a downlight is provided. Said downlight comprises an optoelectronic module and a rim module. The optoelectronic module comprises a light source driving board, a back housing, and a front housing. The light source driving board is disposed between the back housing and the front housing. The light source driving board comprises a light-emitting diode unit and a driving circuit. The rim module has a central opening configured to accommodate the optoelectronic module. The rim module is not integrally formed with the optoelectronic module.

According to another embodiment of the present invention, a downlight is provided. The downlight comprises an optoelectronic module and a rim module. The optoelectronic module comprises a light source driving board, a back housing, and a front housing. The light source driving board is disposed between the back housing and the front housing. The light source driving board comprises a light-emitting diode unit and a driving circuit. The rim module has a central opening configured to accommodate the optoelectronic module. The central opening of the rim module has a circular inner flange, in which when the optoelectronic module is inserted into the central opening of the rim module, the circular inner flange rests against and covers the outer peripheral of the front housing.

According to another embodiment of the present invention, a downlight is provided. Said downlight comprises an optoelectronic module, a rim module, and a trumpet-shaped sleeve. The optoelectronic module comprises a light source driving board, a back housing, and a front housing. The light source driving board is disposed between the back housing and the front housing. The light source driving board comprises a light-emitting diode unit and a driving circuit. The rim module has a central opening configured to accommodate the optoelectronic module. The trumpet-shaped sleeve has a first opening and a second opening. The first opening is in contact with the light source driving board, and is configured to expose the light-emitting diode unit. The second opening is disposed at the inner peripheral of the front housing.

As could be appreciated, this section presents a simplified summary of the disclosure in order to provide a basic understanding to the reader. This summary is not an extensive overview of the disclosure and it does not identify key/critical elements of the present invention or delineate the scope of the present invention.

BRIEF DESCRIPTION OF THE DRAWINGS

The present description will be better understood from the following detailed description read in light of the accompanying drawings as set forth below.

Figure 1:
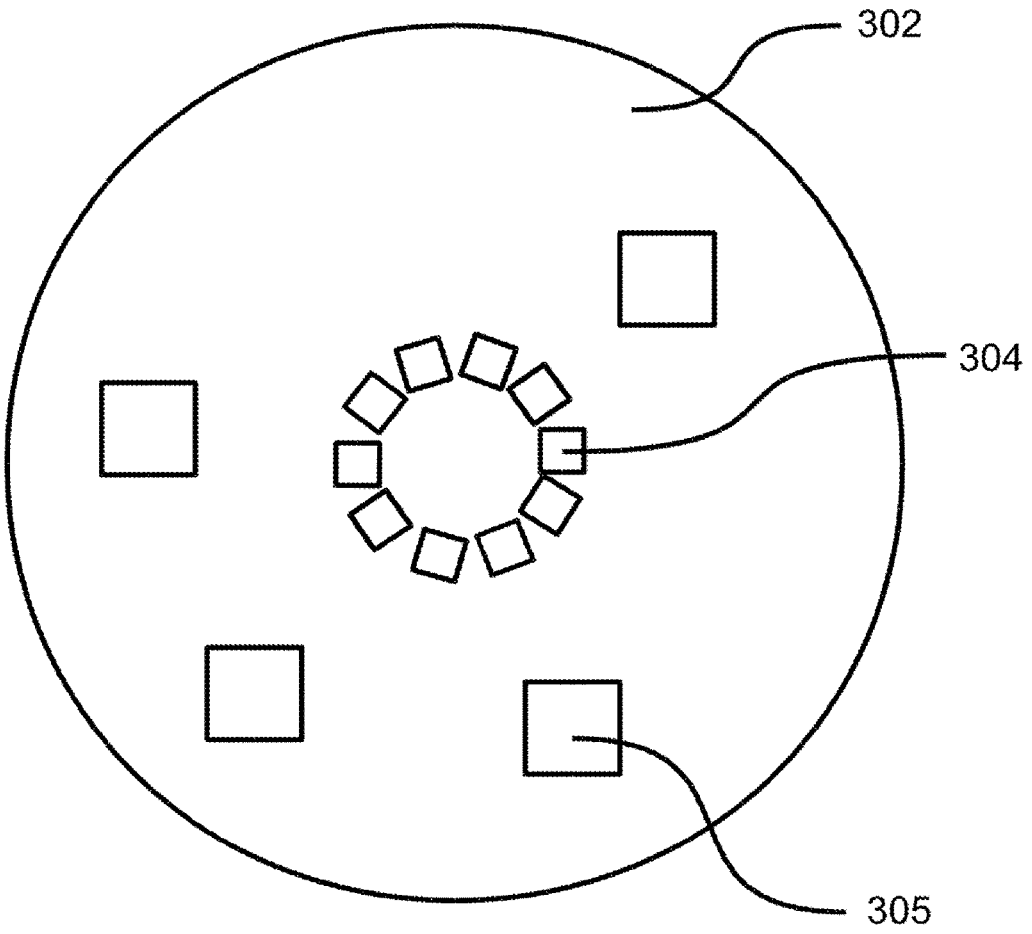
FIG. 1 is a schematic diagram illustrating the light source driving board of the downlight according to one embodiment.

In accordance with common practice, the various described features/elements are not drawn to scale but instead are drawn to best illustrate specific features/elements relevant to the present invention. Also, like reference numerals and designations in the various drawings are used to indicate like elements/parts.

DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

FIG. 1 is a schematic diagram illustrating the light source driving board of the downlight according to one embodiment. Referring to FIG. 1, the light source driving board 302 comprises a light-emitting diode unit 304 and a driving circuit 305. In some embodiments, the light source driving board 302 comprises a plurality of light-emitting diode units 304 arranged in a circular shape. In some embodiments, the light-emitting diode units 304 may be arranged in any other suitable shapes, such as in an array. In some embodiments, the light-emitting diode units 304 concentrate around the central portion of the light source driving board 302, whereas the driving circuits 305 are arranged at the peripheral of the light source driving board 302. In some embodiments, the light-emitting diode units 304 and the driving circuits 305 are surface mounted to the light source driving board 302, thereby substantially decreasing the overall height of downlight.

Figure 2:
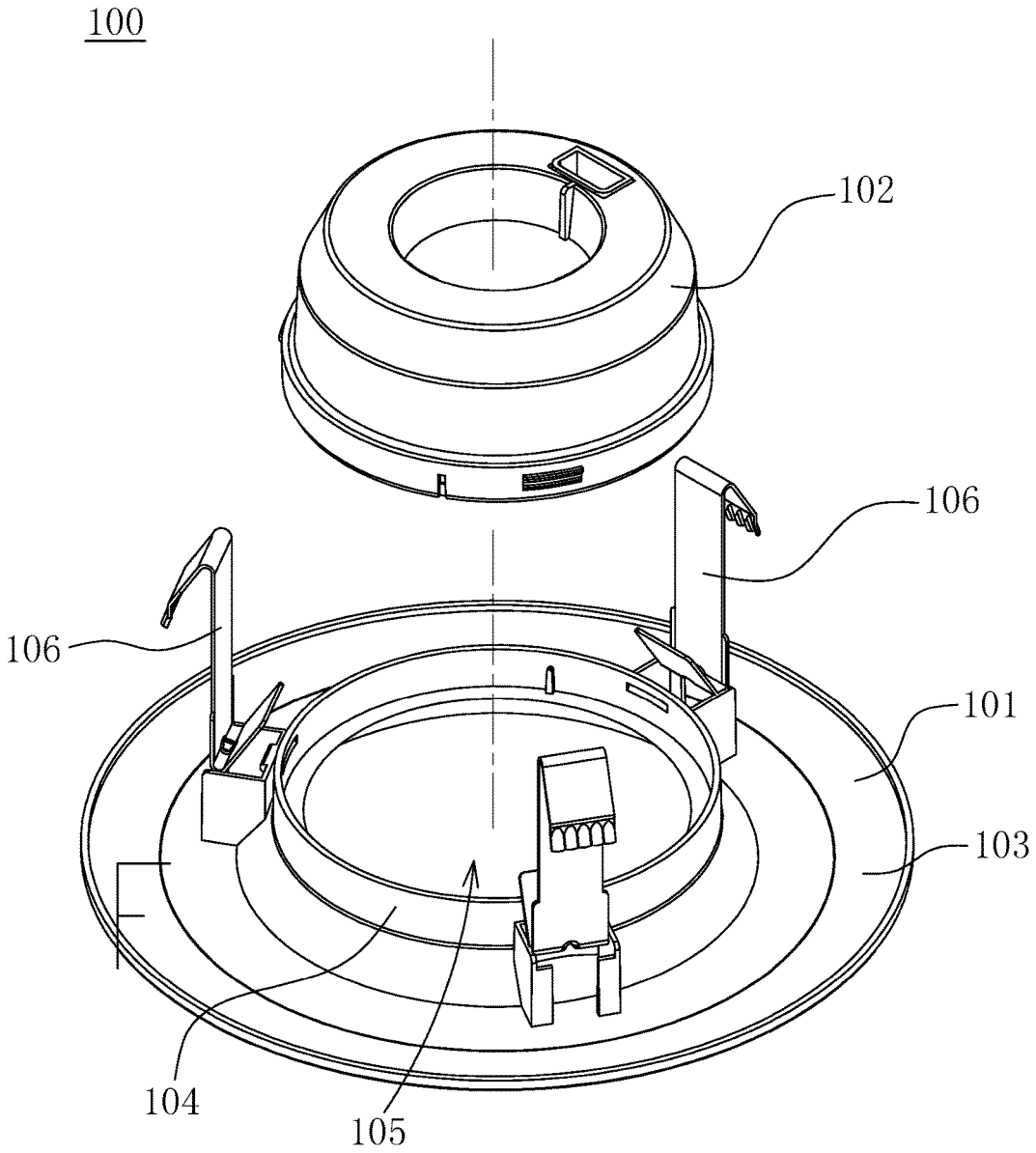
FIG. 2 is a three-dimensional view illustrating the dual-modular downlight according to one embodiment.
Figure 3:
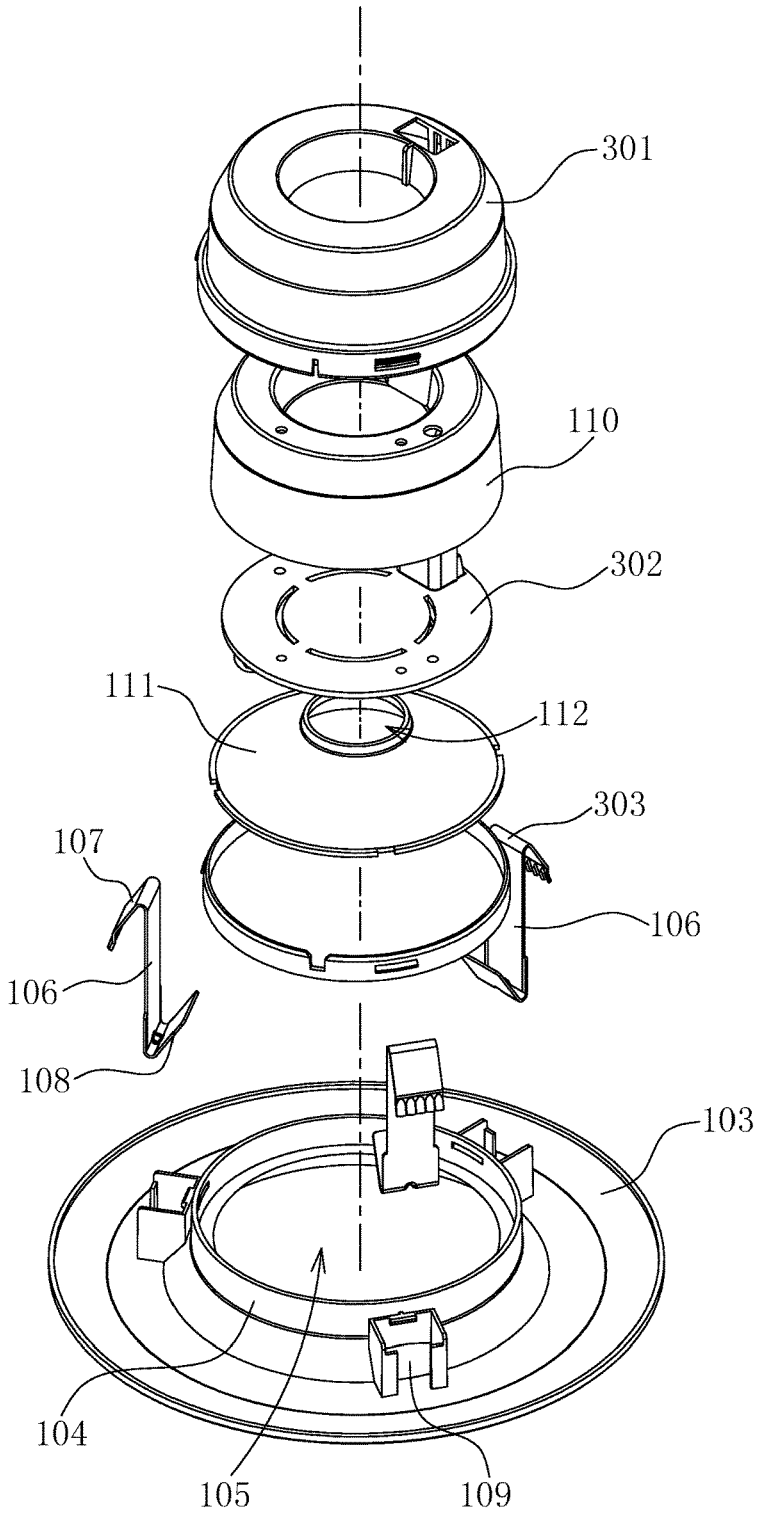
FIG. 3 is an exploded three-dimensional view illustrating the dual-modular downlight according to one embodiment.
Figure 4:
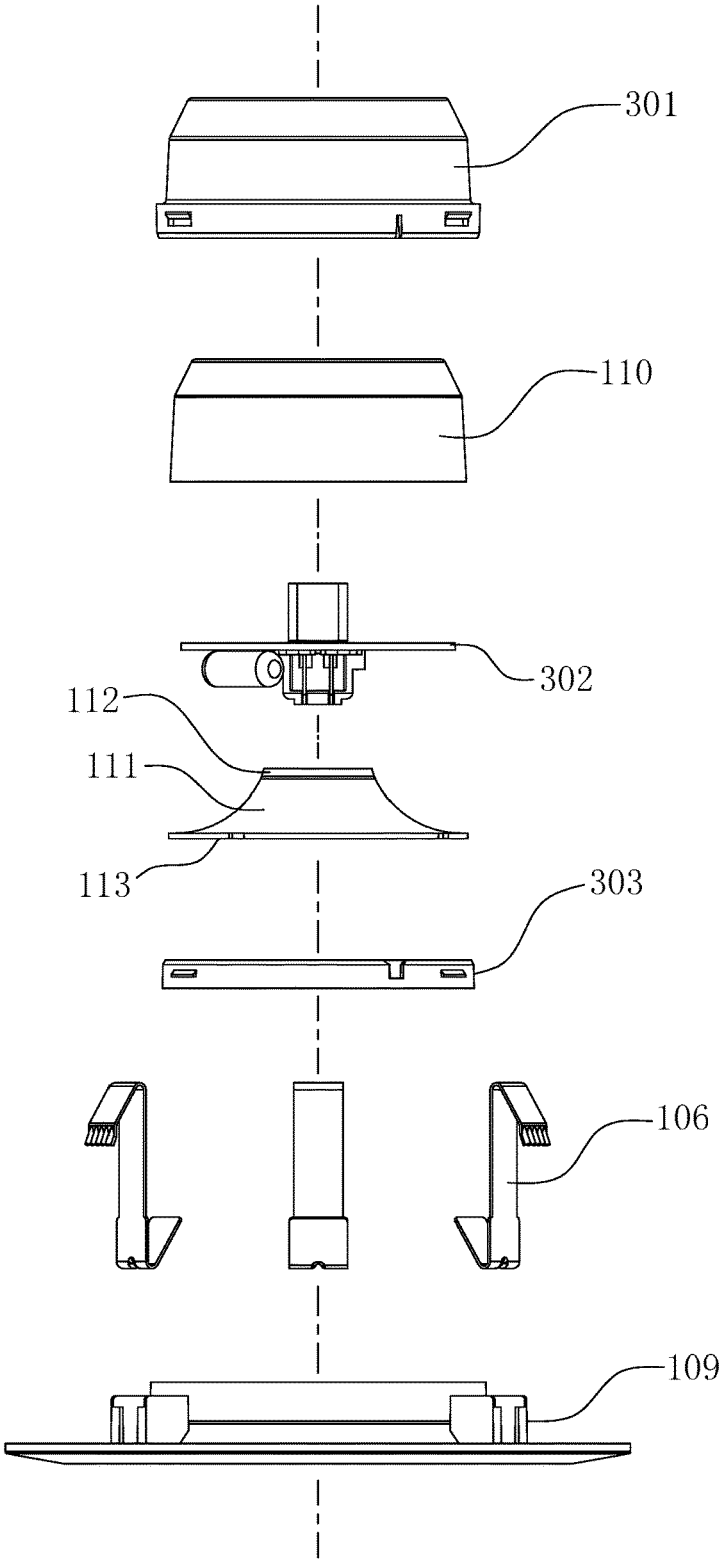
FIG. 4 is an exploded lateral view illustrating the dual-modular downlight according to one embodiment.

FIG. 2 is a three-dimensional view illustrating the dual-modular downlight according to one embodiment of the present invention. FIG. 3 is an exploded three-dimensional view of the dual-modular downlight according to one embodiment of the present invention. FIG. 4 is an exploded lateral view of the dual-modular downlight according to one embodiment of the present invention. Referring to FIG. 2, FIG. 3, and FIG. 4, the dual-modular downlight 100 comprises a rim module 101 and an optoelectronic module 102. The rim module 101 comprises an outer ring 103 and a tubular wall 104. The rim module 101 has an opening 105 for accommodating the optoelectronic module 102. In some embodiments, the rim module 101 comprises a fastener 106, which is connected with the tubular wall 104. The fastener 106 has an acute-angle bent portion 107. The acute-angle bent portion 107 is configured to engage with the interior of the opening on the ceiling or wall so that the rim module 101 may be secured in the ceiling or wall. In some embodiments, the outer ring 103 intersects with the tubular wall 104 at a right angle (i.e., the two are perpendicular). In some other embodiments, the intersecting portion of the outer ring 103 and the tubular wall 104 forms a curve surface.

In some embodiments, the fastener 106 is made of metal, and hence, it is flexible. When the rim module 101 is being pressed into the opening of the ceiling, the fastener 106 is bent slightly, and then when the rim module 101 is completely inserted into the opening of the ceiling, the fastener 106 rebounds to its original state, thereby engaging with the interior of the opening so as to securely fix the rim module 101 at position. In some embodiments, the central opening 105 of the rim module 101 has a circular inner flange, and when the optoelectronic module 102 is inserted into the central opening 105 of the rim module 101, the circular inner flange rests against and covers the outer peripheral of the front housing 303. The circular inner flange may provide the water-proof functionality.

Referring to FIG. 3, the optoelectronic module 102 comprises a back housing 301, a light source driving board 302, and a front housing 303. In some embodiments, the front housing 303 is a diffusion plate, which is configured to diffuse the light so that the user will not feel dazzled. Also referring to FIG. 1, the light source driving board 302 comprises a light-emitting diode unit 304 and a driving circuit 305. The light-emitting diode unit 304 and the driving circuit 305 are placed on a same board, thereby simplifying the manufacture and assembling processes and increasing the manufacture efficiency. In some embodiments, multiple light-emitting diode units 304 are arranged in a ring shape and placed at the central portion of the light source driving board 302 so as to maximize the luminous efficiency of the light-emitting diode 304. In some embodiments, the driving circuits 305 are placed at the peripheral region of the light source driving board 302, so that the voltage and current for driving the light-emitting diode units 304 may be supplied conveniently.

In some embodiments, the optoelectronic module 102 further comprises a metallic heat dissipation component 110. The metallic heat dissipation component 110 may have a ring shape and is disposed between the back housing 301 and the light source driving board 302. The metallic heat dissipation component 110 may provide a better heat dissipation, thereby avoiding the optoelectronic module 102 from overheating. In some embodiments, the dual-modular downlight 100 comprises a trumpet-shaped sleeve 111; the trumpet-shaped sleeve 111 has a first opening 112 and a second opening 113, in which the diameter of the first opening 112 is less than the diameter of the second opening 113. The first opening 112 of the trumpet-shaped sleeve 111 is disposed on the light source driving board 302, wherein the first opening 112 is configured to expose the light-emitting diode unit 304. The second opening 113 of the trumpet-shaped sleeve 111 is disposed right at the interior edge of the front housing 303; in this way, the trumpet-shaped sleeve 111 may be securely clapped between the light source driving board 302 and the front housing 303. The trumpet-shaped sleeve 111 is used as a cover for the driving circuit 305 so that the downlight has a more appealing appearance. When the light-emitting diode 304 emits light, the trumpet-shaped sleeve may also block the dark spots on the front housing 303 caused by the light illuminating on the components of the driving circuit 305. In another embodiment, the trumpet-shaped sleeve 111 may be substituted by a sleeve of any other shapes, such as a conical-shape sleeve. The trumpet-shaped sleeve may be white or beige in color, or have a matte or glossy surface. The trumpet-shaped sleeve is configured to reflect or soften the light.

The rim module 101 and optoelectronic module 102 of the dual-modular downlight 100 are two separate individual modules, rather than a module formed integrally. In this way, the two modules may be manufactured and tested separately. Since these two modules are separate modules, the respective size of each module is smaller. As could be appreciated, conventional downlights use an integrally formed module comprising the rim module and the optoelectronic module; and the size of this module is greater. During the testing period, the number of downlights that can be stored in the specific space is smaller for products with greater sizes, which is inconvenient for the testing. In contrast, the present disclosure proposed a multi-modular approach that compartmentalized the downlight 100 into separate, individual modules, so that the respective size of each module decreases, thereby allowing a more convenient manufacturing and testing process. For example, during the aging test, using the same space, more optoelectronic modules 102 may be subjected to the aging test, as compared with conventional downlights. Accordingly, the testing efficiency improves, and testing speeds increases. Similarly, when one of the separate modules is damaged or broken, it is feasible to replace the damaged or broken module, rather than replacing the whole downlight. Therefore, the cost for material may be reduced.

In some embodiments, there is a raised flat face at the center of the heat dissipation component 110; said raised flat face may be in close contact with the back of the light source driving board 302. As could be appreciated, light-emitting diode units 304 tend to generate heat; therefore, disposing the raised flat face at the center of the heat dissipation component 110 so that it is in close contact with the center region of the front face of the light source driving board 302 where the light-emitting diode units 304 concentrate, facilitates heat dissipation. In some embodiments, the peripheral of the heat dissipation component 110 is disposed with a recess through hole; said recess through hole allows the passage of the power cable. After passing through the recess through hole, the power cable connects with the light source driving board 302, so as to supply the power to the light source driving board 302. In some embodiments, there may be a plurality of recess through holes. In some embodiments, the outer ring 103 may be a circular ring. In some other embodiments, the outer ring 103 may be a rectangular ring. The outer ring 103 may come in various sizes for optoelectronic modules 102 of different specifications and for different sizes of installation holes. This modularized approach may reduce the cost and increase the flexibility.

In some embodiments, referring to FIG. 2 and FIG. 3, the fastener 106, in addition to the bent portion 107, comprises another bent portion 108. The bent portion 108 has a barb-shape, in which the bard may be inserted into the inner groove 109 of the outer ring. The barb-shaped bent portion 108 may be pressed or locked into the outer ring 103 without using a screw, which is convenient.

The dual-modular downlight 100 according to the present disclosure simplifies the structure design, increases the manufacturing efficiency, and decreases the cost. Each functional part is modularized, in which the single module may function on its own and separately manufactured, thereby expanding the application of the product, enhancing the manufacturing efficiency and increasing the competitiveness of the product. The present light-emitting diode unit 304 and driving circuit 305 are designed combinatorially, and are surface-mounted on a single light source driving board 302. This manufacturing process are suitable for automated mass production, which provides a higher manufacturing efficiency and is easy to assemble; in particular, the screws are only required for fixing the heat dissipation component, while all the other components do not require a screw. The overall height of the final light is substantially decreased to a ratio of about 20-25%, thereby greatly reducing the costs for material and manufacturing with a cost reduction rate of about 25-30%.

Both the rim module 101 and the optoelectronic module 102 may be manufactured separately, and the two modules are easy to assemble using a highly automated process, thereby improving the manufacturing efficiency significantly. The optoelectronic module 102 may come in various sizes; for example, it is feasible to manufacture optoelectronic modules 102 of 4 inches, 5 inches, or 6 inches separately, and these modules can be sold as individual products. By using other surface ring configuration, the module may be used to form products of new shapes, thereby greatly increasing the adaptability of the product and significantly increasing the competitiveness of the product. This modular design realizes the combinations of 4-inch 5-inch, and 6-inch optoelectronic modules 102 with various rim modules 101 (e.g., N44 and N48 surface ring), which realizes the standardized manufacturing of products, decreases the number of modules for different products, shortens the development cycle of the product, reduces the number of times of changing modules during the manufacture, and increases the manufacturing efficiency. At the same time, the present design also decreases the time required by the worker to get familiar with different assembly processes for various products; the skill of the worker increases by making only one product, which in turn increases the manufacturing efficiency. Moreover, the decrease in the height of the product reduces the cost for the packaging materials, and increases the number of products that can be loaded in a cargo, which decreases the transportation cost and lowers the overall cost.

The above-mentioned embodiments may solve one or more technical problems due to their respective technical feature(s).

Although various embodiments of the invention have been described above with a certain degree of particularity, or with reference to one or more individual embodiments, those with ordinary skill in the art could make numerous alterations to the disclosed embodiments, such as the addition or deletion of one or more elements, without departing from the spirit or scope of this invention.

What is claimed is:

1. A downlight, comprising, an optoelectronic module, comprising a light source driving board, a back housing, and a front housing, wherein the light source driving board is disposed between the back housing and the front housing, and the light source driving board comprises a light-emitting diode unit and a driving circuit; and a rim module, having a central opening configured to accommodate the optoelectronic module;

wherein the central opening of the rim module comprises a circular inner flange, and when the optoelectronic module is inserted into the central opening of the rim module, the circular inner flange rests against and covers the peripheral of the front housing by engaging a tubular wall of the circular inner flange with a corresponding external surface of the front housing, and another type of the rim module with the same size of the circular inner flange is replaceable for constructing products for different standards.

2. The downlight according to the claim 1, wherein the rim module comprises a fastener, wherein the fastener is fixed on the tubular wall.

3. The downlight according to the claim 2, wherein the fastener is a metallic fastener.

4. The downlight according to the claim 1, wherein the front housing is a diffusion plate.

5. The downlight according to the claim 1, wherein the light source driving board comprises a plurality of light-emitting diode units arranged in a ring-shape.

6. The downlight according to the claim 1, wherein the rim module comprises outer ring, wherein the outer ring is a circular ring.

7. The downlight according to the claim 1, wherein the rim module comprises outer ring, wherein the outer ring is a rectangular ring.

* * * * *